United States Patent [19]

Oude Alink et al.

[11] 3,994,975

[45] Nov. 30, 1976

[54] CYCLOHEXYLAMINES

[75] Inventors: Bernardus A. Oude Alink, St. Louis; Neil E. S. Thompson, University City, both of Mo.

[73] Assignee: Petrolite Corporation, St. Louis, Mo.

[22] Filed: Oct. 7, 1974

[21] Appl. No.: 512,423

[52] U.S. Cl. ..... 260/563 C; 44/74; 71/121; 252/390; 260/563 D; 260/563 P; 260/999

[51] Int. Cl.[2] ..... C07C 85/08; C07C 87/36; C07C 87/45

[58] Field of Search ..... 260/563 C, 563 D, 563 P

[56] References Cited

UNITED STATES PATENTS

| | | | |
|---|---|---|---|
| 2,636,902 | 4/1953 | Taylor et al. | 260/563 C X |
| 2,693,491 | 11/1954 | Prichard et al. | 260/563 C |
| 3,154,580 | 10/1964 | Robinson et al. | 260/563 C |
| 3,520,933 | 7/1970 | Adam et al. | 260/563 C X |

OTHER PUBLICATIONS

Chemical Abstracts, v 74, 42011n (1971).

Chemical Abstracts, v 59, 8609f (1963).

Chemical Abstracts, v 74, 123418c (1971).

Chemical Abstracts, v 50, 167e–168f (1956).

Chemical Abstracts, v 41, 6275f (1947).

Chemical Abstracts, v 41, 5892–5893 (1947).

Wagner et al., Synthetic Organic Chemistry, John Wiley & Sons, Inc., N.Y., pp. 662, 663, 700, 701 (1953).

*Primary Examiner*—Helen M. S. Sneed

*Attorney, Agent, or Firm*—Sidney B. Ring; Hyman F. Glass

[57] ABSTRACT

This invention relates to the reductive amination of unsaturated cyclic ketones; to cyclic amines prepared thereby; and to uses thereof. For example, when isophorone is reductively aminated, trimethyl cyclohexylamines and cyclohexenamines are obtained. This invention also relates to uses thereof, for example, as fuel additives, particularly for stabilizing distillate fuels.

16 Claims, No Drawings

CYCLOHEXYLAMINES

Certain unsaturated cyclic ketones are known, for example cyclohexyl ketones such as isophorone.

We have now discovered a facile method for the reductive amination of such unsaturated cyclic ketones which comprises reacting such unsaturated ketones with an amine in the presence of hydrogen so as to not only saturate the double bond but also to convert the ketone group to an amino group.

This is illustrated by the following reaction:

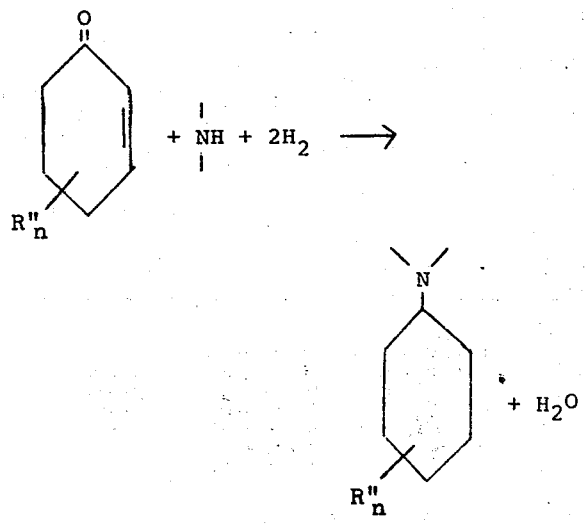

where R'' is hydrogen or a substituted group such as alkyl, etc. Any amine or substituted amine can be employed in the reductive amination provided it has a

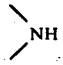

group (i.e.; primary or secondary amines and the remaining groups of the amine do not interfere with the reductive amination.

The reaction is carried out in the presence of a hydrogenation catalyst such as palladium, platinum, nickel, etc.; at a suitable temperature, for example from ambient to 200° C. or higher, but preferably 50°–150° C.; at pressures sufficient to contain hydrogen in the reaction vessel, such as about 10–2000 psi, or higher but preferably about 200–1000 psi; for a sufficient period of time for the reaction to take place such as from about 10 minutes to 24 hrs. or longer, preferably from about ½ hr. to 6 hrs.; in solvents which do not interfere with the catalyst, reactants, or products such as water, alcohol, hydrocarbons, esters, etc.

This invention also includes mixtures of fully reduced cyclic amines and partially reduced amines, for example, mixtures of

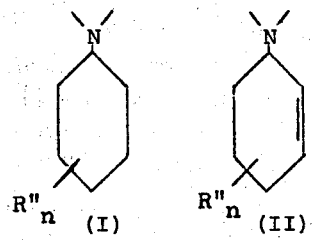

in varying proportions such as from about 5–95% by weight of II, such as from about 15–85%, for example from about 25–75%, but preferably from about 30–50%.

The preferred amine products are

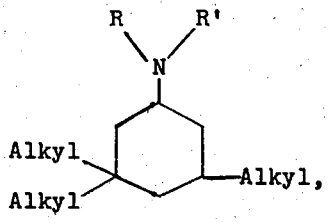

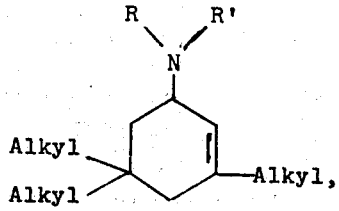

or mixtures thereof, where

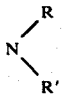

represents an amino group, A, having a cyclohexyl, hydroxyalkyl or aminoalkyl radical attached to the nitrogen atom, as illustrated in the following examples, which are presented for purposes of illustration and not of limitation. These examples are also illustrative of the use of ethanol as the reaction solvent in amination reactions employing ammonia or one of the above described amine reactants.

EXAMPLE 1

N,N,-Dimethyl-3,5,5-trimethylcyclohexylamine

A mixture of 15.8g of dimethylamine, 32g of isophorone, 2g of 5% Palladium on charcoal and 150cc of ethanol was placed in an autoclave. Hydrogen gas was added to increase the pressure to 500 psi. The reaction mixture was heated to 95° C. and kept with stirring at 95° C. for 1 hr. Hydrogen gas was added during the reaction, to maintain a pressure of 330–500 psi. After the mixture was allowed to cool to ambient temperature, the solvent and the water produced were removed under diminished pressure. Distillation yielded 35g of N,N-dimethyl-3,5,5-trimethylcyclohexylamine; $b_{760}$ 196°–198° C; nuclear magnetic resonance spectrum, δ in ppm, 2.18 s, 6H; 2.15–1.00 m's, 8H; 1.17 s, 3H; 0.90 s and 0.88 d, 6H.

Anal. Calced. for $C_{11}H_{23}N$: N, 8.28. Found: N, 8.26.

EXAMPLE 2

N-Methyl-3,5,5-trimethylcyclohexylamine

A mixture of 108g (0.79M.) of isophorone, 150 cc of ethanol and 2g of 5% platinum on charcoal was placed in a 1 liter autoclave. The system was flushed 2 times with hydrogen gas. A sample of 24.5g (0.79M) of methylamine was added and hydrogen gas was introduced to raise the pressure to 500 psi. The reaction mixture was stirred and heated to 100° C. and kept at 100° C. for 34 minutes, while maintaining a pressure of 400–500 psi by occasional addition of hydrogen gas. The reaction mixture was allowed to cool to ambient temperature. The catalyst was removed by filtration and the solvent and water produced was removed by distillation under diminished pressure to yield 97g of a mixture of 20% N-methyl-3,5,5-trimethyl-2 cyclohexenamine and 80% of N-methyl-3,5,5-trimethylcyclohexylamine. $b_{760}$ 186°–188° C, nuclear magnetic resonance spectrum, δ in ppm.; 2.78 m, 1H; 2.32, s, 3H; 2.13–1.15 m's, 7H; 1.10 s, 3H; 0.85 s and 0.87 d, 6H.

Anal. Calc.ed for $C_{10}H_{21}N$: N, 9.03. Found: N, 9.00.

EXAMPLE 3

3,5,5-Trimethylcyclohexylamine

A mixture of 100g of isophorone (0.725M), 150 cc of ethanol and 10g of Raney nickel was placed in a 1 l. autoclave. The system was flushed 2 times with hydrogen gas and 25g of ammonia gas was added. The mixture was stirred and hydrogen gas was added to increase the pressure to 500 psi. The reaction mixture was heated for 1 hour at 120° C. while hydrogen gas was added to maintain a pressure of 350–500 psi. The mixture was cooled to ambient temperature. The catalyst centrifuged off, and the solvent and water produced removed under diminished pressure to yield 87g of 3,5,5-trimethylcyclohexylamine, $b_{760}$ 176°–177° C.

Anal. Calc.ed for $C_9H_{19}N$: N, 9.93. Found: N, 9.81.

As described in example 1, several amines were reacted with isophorone under reductive conditions. The results are summarized in Table I.

The following series of mixtures were also prepared by less than complete reduction to yield the following mixtures:

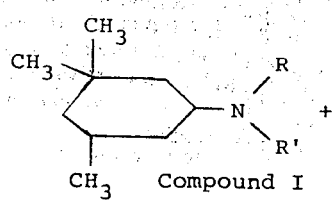

Compound I

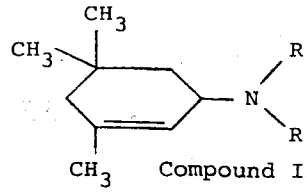

Compound II

| Ex. | | |
|---|---|---|
| A | R=H, R'=$CH_3$; | 43% by weight of compound II |
| B | R=H, R'=$CH_3$; | 25% by weight of compound II |
| C | R=H, R'=$CH_3$; | 11% by weight of compound II |
| D | R=H, R'=$CH_3$; | 0% by weight of compound II |
| E | R,R'=$CH_3$ | 40% by weight of compound II |
| F | R,R'=$CH_3$ | 0% by weight of compound II |

The compositions of this invention are useful as fuel additives, particularly for stabilizing distillate fuels.

In addition to their uses as fuel additives, the compositions of this invention may be employed as corrosion inhibitors, biocides, (i.e., bactericide, algicides, etc.) as well as other uses.

We claim:

1. A process of preparing cyclohexylamines by reductive amination which comprises reacting a cy-

TABLE I

| Ex. No. | Catalyst | g. of catalyst | Amine | g. of amine | g. of Isophorone | Reaction Pressure psi | Reaction temp. °C | Reaction time hrs | Product Formed |
|---|---|---|---|---|---|---|---|---|---|
| 4 | 5% Pt/C | 2 | Methyl amine | 52 | 100 | 400–500 | 100 | 1 | 57% N-methyl-3,5,5-trimethylcyclohexylamine; 43% N-methyl-3,5,5-trimethylcyclohexen-2-amine |
| 5 | 5% Pt/C | 2 | Methyl amine | 26 | 110 | 350–500 | 100 | 3½ | 85% N-methyl-3,5,5-trimethylcyclohexylamine; 15% N-methyl-3,5,5-trimethyl cyclohexen-2-amine |
| 6 | 5% Pd/C | 2 | Methyl amine | 26 | 57 | 330–500 | 95 | 1 | 100% N-methyl-3,5,5-trimethylcyclohexylamine |
| 7 | Raney Ni | 10 | Methyl amine | 34 | 75 | 400–560 | 120 | 1 | 91% N-methyl-3,5,5-trimethylcyclohexylamine; 9% 3,5,5-trimethylcyclohexanol |
| 8 | 5% Pt/C | 2 | Dimethyl amine | 27 | 75 | 400–500 | 120 | 6 | 60% N,N-dimethyl-3,5,5-trimethylcyclohexylamine; 40% N,N-dimethyl-3,5,5-trimethylcyclohexen-2-amine |
| 9 | Raney Ni | 10 | Dimethyl amine | 27 | 75 | 400–500 | 125 | 2.5 | 60% N,N-dimethyl-3,5,5-trimethylcyclohexylamine; 3,5,5-trimethyl cyclohexanol |
| 10 | 5% Pt/C | 2 | Cyclohexyl amine | 53.5 | 75 | 450–500 | 100 | 4 | 80% N-Cyclohexyl-3,5,5-trimethylcyclohexylamine; 20% N-Cyclohexyl-3,5,5-trimethylcyclohexen-2-amine |
| 11 | 5% Pt/C | 2 | Ethylene diamine | 33 | 75 | 400–500 | 110 | 4 | 42% N-(3,5,5-trimethylcyclohexyl) ethylenediamine; 58% N-(3,5,5-trimethylcyclohexen-2) ethylenediamine |
| 12 | 5% Pd/C | 3 | Monoethanol amine | 61 | 138 | 450–580 | 95 | 3 | 100% N-(3,5,5-trimethylcyclohexyl-ethanolamine |

clohexenone with a primary or secondary amine and hydrogen in the presence of a hydrogenation catalyst.

2. The process of claim 1 where the cyclohexenone is alkyl-substituted.

3. The process of claim 2 where the alkyl group is methyl.

4. The process of claim 3 where the methyl-substituted cyclohexenone is isophorone.

5. Compounds of the formula

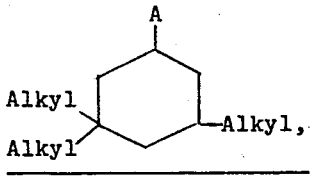

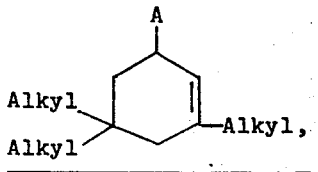

or mixtures thereof, where A represents an amino group having a cyclohexyl, hydroxyalkyl or aminoalkyl radical attached to the nitrogen atom.

6. The compounds of claim 5 of the formula

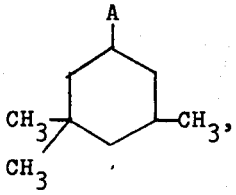

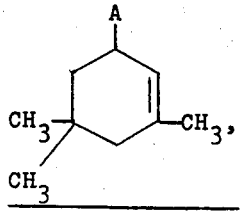

or mixtures thereof, where A is as defined in claim 5.

7. The compounds of claim 6 where A is

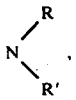

R being hydrogen or methyl and R′ being cyclohexyl, hydroxyalkyl or aminoalkyl.

8. The compounds of claim 7 where R is hydrogen and R′ is $—CH_2CH_2NH_2$.

9. The compounds of claim 7 where R is hydrogen and R′ is cyclohexyl.

10. The compounds of claim 7 where R is hydrogen and R′ is $—CH_2CH_2OH$.

11. The process of claim 1 wherein the hydrogenation catalyst is selected from the group consisting of palladium, platinum and nickel, the reaction temperature is at least ambient and the pressure is at least 10 psi.

12. The process of claim 11 wherein the reaction is carried out in a solvent which does not interfere with the catalysts, reactants or product.

13. A process for preparing cyclohexylamines by reductive amination which comprises reacting a cyclohexenone with hydrogen and a member of the group consisting of ammonia, primary amines and secondary amines, said reaction group being carried out in ethanol as a solvent and in the presence of a hydrogenation catalyst.

14. The process of claim 13 wherein the hydrogenation catalyst is selected from the group consisting of palladium, platinum and nickel, the reaction temperature is at least ambient and the pressure is at least 10 psi.

15. The process of claim 1 wherein said amine is selected from the group consisting of methyl amine, dimethyl amine, cyclohexyl amine, ethylene diamine and monoethanol amine.

16. The process of claim 15 wherein the hydrogenation catalyst is selected from the group consisting of palladium, platinum and nickel, the reaction temperature is at least ambient and the pressure is at least 10 psi.

* * * * *